US005203455A

United States Patent [19]

Hewelt et al.

[11] Patent Number: 5,203,455

[45] Date of Patent: Apr. 20, 1993

[54] PACKAGE FOR ZINC-AIR BATTERIES

[75] Inventors: Helmut Hewelt; German Schulz, both of Ellwangen, Fed. Rep. of Germany

[73] Assignee: Varta Batterie Aktiengesellschaft, Hannover, Fed. Rep. of Germany

[21] Appl. No.: 906,520

[22] Filed: Jun. 30, 1992

[30] Foreign Application Priority Data

Aug. 26, 1991 [DE] Fed. Rep. of Germany ..... 4128248

[51] Int. Cl.[5] ..... B65D 73/02

[52] U.S. Cl. ..... 206/333; 53/453; 206/460; 206/469; 206/471

[58] Field of Search ..... 53/474, 453; 206/461, 206/460, 467, 469, 470, 471, 495, 813, 333

[56] References Cited

U.S. PATENT DOCUMENTS

| | | | |
|---|---|---|---|
| 4,015,708 | 4/1977 | Kelm | 206/333 |
| 4,209,091 | 6/1980 | Lieberman | 206/333 |
| 4,450,959 | 5/1984 | Sommer | 206/461 X |
| 4,905,866 | 3/1990 | Bartell et al. | 206/531 X |
| 4,958,736 | 9/1990 | Urheim | 206/531 |
| 4,988,004 | 1/1991 | Intini | 206/469 X |
| 5,014,851 | 5/1991 | Wick | 206/461 X |
| 5,033,616 | 7/1991 | Wyser | 206/469 X |
| 5,150,793 | 9/1992 | Tannenbaum | 206/531 |

*Primary Examiner*—Jimmy G. Foster
*Assistant Examiner*—Jacob K. Ackun, Jr.
*Attorney, Agent, or Firm*—Weiser & Associates

[57] ABSTRACT

A push-through, blister card package for zinc-air batteries includes a cardboard support to which is sealed a transparent plastic foil with cup-shaped recesses for holding button cells. The battery bases, which are provided with air supply holes, are attached to a shared adhesive foil. When a battery is pushed through the support, which is perforated in the region for battery removal, the adhesive foil automatically detaches from the battery while remaining an integral part of the package.

6 Claims, 1 Drawing Sheet

PACKAGE FOR ZINC-AIR BATTERIES

BACKGROUND OF THE INVENTION

This invention pertains to a package for zinc-air batteries. Zinc-air batteries in the form of button cells have been extensively used for entertainment electronics, pocket calculators and especially hearing aids. This has made the packaging of these mass-produced articles an important factor. On the one hand, such packaging must be economical. On the other hand, such packaging must have a pleasing appearance to stimulate consumer interest. What is more, since today's consumer usually cannot expect to receive personal advise (e.g., at a supermarket or department store), the design of the package (and possibly any directions for use printed on the package) constitutes a true marketing aid.

Much like pharmaceutical tablet packages, blister packages were originally introduced for gas-tight button cells of the rechargeable Ni/Cd system or the primary systems $Ag_2O/Zn$ and HgO/Zn. Often, these packages were comprised of two plastic shells that fit together. One of the shells was divided into an annularly arranged series of compartments for holding the batteries, which could be turned relative to the other shell in such a way that each of the battery compartments would, in succession, become aligned with an opening in the opposing shell, allowing removal of a battery from the package.

However, zinc-air batteries presented a special problem since the air supply holes provided in the cathode case had to be protected from the entrance of air and moisture until the cell was ready for use (i.e., the package also had to serve as a suitable storage container for the batteries). An example of a packaging unit directed to this end is the strip package which is described in DE-OS 36 30 926. In this package, the batteries are completely protected from their surroundings by a tear-resistant, air-tight and transparent plastic foil container including cup-shaped hollows for housing the cells and an aluminum foil sealed to the cup-shaped hollows. U.S. Pat. No. 4,015,708 describes a folding box which serves as a packaging unit for zinc-air batteries, and which includes a cardboard support with circular recesses for holding the batteries, and a foil cover on the underside of the support which adhesively receives the bases of the cells.

The desire to reduce the material and production costs of known packages has often limited such packaging to a tag glued to the bottom of the battery. The tag is then removed by hand before the battery is placed into service. However, removal of the tag (e.g., by pulling on a small tab associated with the tag) can be rather difficult, especially for the elderly and for frail individuals. Furthermore, persons unfamiliar with this type of packaging will at times try to use the battery without first removing the tag. Then, thinking the inactive battery is defective, the cell is thrown away in error.

SUMMARY OF THE INVENTION

It is therefore the primary object of the present invention to provide a packaging unit for zinc-air batteries which would eliminate the above-mentioned disadvantages encountered in activating the battery, yet which will allow for prolonged storage and display of the cells in an attractive way.

This and other objects which will be apparent are achieved in accordance with the present invention by providing a package for zinc-air batteries having a sealing foil for adhesively receiving each battery's base, thereby occluding the air supply holes formed in the base, which includes a clear plastic cover having cup-shaped recesses which substantially conform to the shape of each battery, a support adhesively sealed to the clear plastic cover and which permits the batteries to be pushed through the support for use, and a foil fastened to the support and extending into areas of the support through which the batteries can be pushed, wherein at least the foil is provided with an adhesive coating for receiving the bases of the batteries, and wherein the foil remains associated with the support after a battery has been pushed through and removed. Thus, the package of the present invention takes the form of a strip-like blister pack with an integral adhesive seal. The advantage of this package is that when a battery is pushed out of the blister, the adhesive foil is automatically removed from the cell, remaining with the package so that incorrect battery usage cannot occur.

For further detail regarding a preferred package produced in accordance with the present invention, reference is made to the description which is provided below, taken in conjunction with the following illustrations.

DETAILED DESCRIPTION OF A PREFERRED EMBODIMENT

Figure 1:
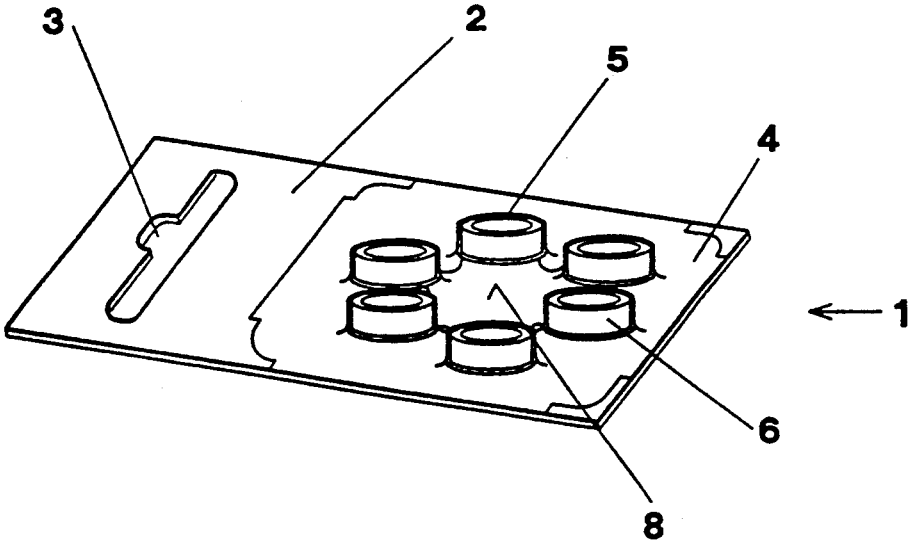
FIG. 1 is an isometric view of the multiple package of the present invention.

Referring to FIG. 1, the package 1 is formed upon a glaze-coated cardboard support 2 having an eye 3 for suspending the package 1 from a display. A transparent plastic foil 4 with cup-shaped recesses 5 (i.e., blisters) for receiving and holding a plurality of button cells 6 is sealed to the support 2. Free space on the support can be used for labeling or decorative purposes (logos), if desired.

Figure 2:
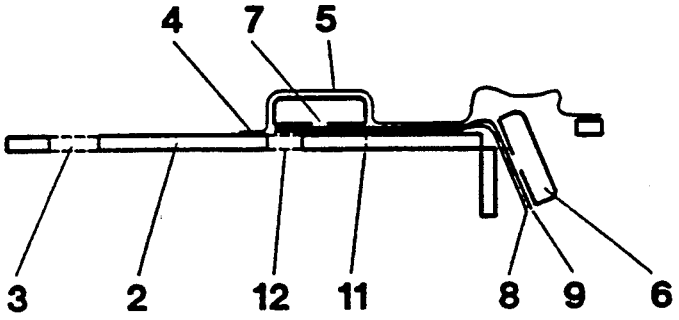
FIG. 2 is an end view of the package of FIG. 1.

Referring to FIG. 2, the air supply holes 7 in the bases of the button cells 6 are sealed in air-tight fashion to a stripping foil 8, which underlies the button cells 6. The foil 8 serves the basic function of the stripping and sealing foils (i.e., tabs) common to batteries of this general type. To this end, the foil 8 is coated on its upper surface with an appropriate adhesive 9, and the button cells 6 are attached to the adhesive coating 9 of the foil 8, retaining the button cells 6 to the foil 8 and sealing the air supply holes 7.

Figure 3:
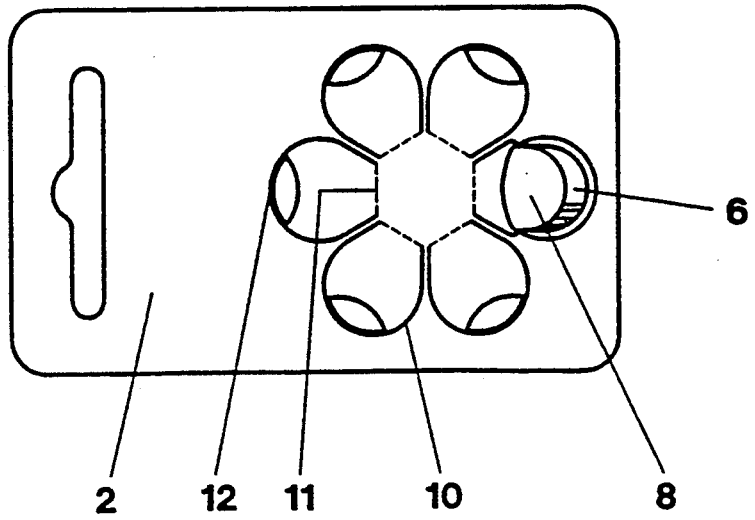
FIG. 3 is a bottom plan view of the package of FIG. 1.

Referring to FIG. 3, the stripping foil 8 also extends outwardly from the center of the circular arrangement of button cells 6, beneath the bases of the button cells 6, and around the regions of the support 2 through which the button cells 6 can be pushed. As a result, the outline of the stripping foil 8 resembles a rosette having a number of tongue-shaped sections equal to the number of button cells 6 which are mounted on the stripping foil 8.

In production, each blister 5 is positioned with its cup-shaped opening turned upwardly. The stripping foil 8 is attached to the bases of the button cells 6, and mounted to the plastic foil 4 (with an appropriate adhesive). The cardboard support 2 is then sealed to the resulting assembly. In this fashion, the sealing adhesive applied to the cardboard support 2 can produce a firm bond between the cardboard support 2 and the stripping foil 8, while leaving hollows for holding the button cells 6 in place.

The underside of the stripping foil 8 is also affected by sealing of the cardboard support 2 to the plastic foil 4. The firm adhesive bond of the stripping foil 8 to the cardboard support 2 can be limited to the central regions located between the cup-shaped recesses 5. In such case, the stripping foil 8 can rest freely on the cardboard support 2 in those areas which are covered by the cup-shaped recesses 5 of the plastic foil 4, and through which the button cells 6 must be pushed for their removal from the package 1 (i.e., the tongue-shaped sections adhering to the bases of the button cells).

In these regions, the cardboard support 2 is provided with perforations 10, 11 (see FIGS. 2 and 3) that conform to the shape of the button cells 6, which are supplemented by recesses 12 formed in the cardboard support 2 in order to facilitate breaking (separation) of the cardboard support 2 along a rupture line 11 developed when a button cell 6 is pushed through. As shown at the right of FIG. 2, the button cell 6 initially adheres to the stripping foil 8. However, the button cell 6 is easily removed from the stripping foil 8 while the stripping foil 8 remains associated with the cardboard support 2 as an integral part of the package 1.

As is best seen in FIG. 3, the recesses 12 in the cardboard support 2 form narrow windows with lens-shaped out-lines. Edge sections of the button cells 6, or of the tongue-shaped segments of the stripping foil 8 adhering to the bases of the button cells 6, are visible through these openings. Since the undersides of these tongue-shaped segments are free of the adhesive coating 9 (see FIG. 2), the user cannot get any adhesive on his or her fingers when the button cell 6 is removed from the stripping foil 8.

Thus, the package 1 allows for the uncomplicated and correct removal of button cells without the need for much force, while ensuring that the button cells remain fresh, even during prolonged storage.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A package for zinc-air batteries each having a base and air supply holes formed in the base, the package comprising a clear plastic cover having cup-shaped recesses which substantially conform to the shape of each battery, a rupturable support fastened to the cover so that the batteries can be pushed through the support to rupture said support, and a foil fastened between the support and the cover and extending to regions of the support through which the batteries can be pushed, wherein the foil includes an adhesive coating for adhering the base of each battery to said foil and for sealing the air supply holes, and wherein the foil remains associated with the support after the batteries have been pushed through and removed.

2. The package of claim 1 wherein the support includes perforation lines conforming to the shape of the batteries in the regions covered by the recesses.

3. The package of claim 2 wherein the support includes hollows associated with the perforation lines.

4. The support of claim 1 wherein the foil is rosette shaped.

5. A method for forming the package of claim 1, comprising the steps of:

attaching the batteries to the adhesive coating formed on the foil, sealing the air supply holes;

attaching the foil and the batteries to the clear plastic cover so that the batteries are received within the cup-shaped recesses which substantially conform to the shape of each battery; and attaching the support to the clear plastic cover so that the support overlies the foil, and so that the batteries can be pushed through the support for use.

6. A method for using the package of claim 1, which comprises the steps of:

pushing a battery through the support; and removing the battery from the foil while the foil remains associated with the support and the cover after the battery has been pushed through and removed.

* * * * *